US005126708A

United States Patent [19]

Palaia et al.

[11] Patent Number: 5,126,708

[45] Date of Patent: Jun. 30, 1992

[54] MOLDED CASE CIRCUIT BREAKER BRAID CONDUCTOR WITH STRAIN RELIEF

[75] Inventors: Franklin P. Palaia, Bristol; Michael C. von Kannewurff, Middlebury; Joseph M. Palmieri; Richard E. Bernier, both of Southington; Erich J. Pannenborg, New Haven; Roger N. Castonguay, Terryville, all of Conn.

[73] Assignee: General Electric Company, New York, N.Y.

[21] Appl. No.: 735,746

[22] Filed: Jul. 25, 1991

[51] Int. Cl.[5] ..... H01H 75/12

[52] U.S. Cl. ..... 335/35; 335/172; 335/167

[58] Field of Search ..... 335/21, 22, 6, 35-38, 335/167-175; 336/192; 174/94 R

[56] References Cited

U.S. PATENT DOCUMENTS

| | | | |
|---|---|---|---|
| 3,702,387 | 11/1972 | Klein | 338/329 |
| 4,174,563 | 11/1979 | Simpson | 174/94 R |
| 4,583,065 | 4/1986 | Favre-Tissot | 335/106 |

*Primary Examiner*—Lincoln Donovan

*Attorney, Agent, or Firm*—Richard A. Menelly; Fred Jacob

[57] ABSTRACT

A molded case circuit interrupter of the type employing a thermal-magnetic trip unit to interrupt circuit current utilizes a flexible electrical braid conductor to connect between the thermal-magnetic trip unit and the movable contact arm. A helical spring arranged around the braid conductor at the welded connection with the movable contact arm provides long-term strain relief. A metal phosphate coating on the surface of the circuit breaker operating cradle and latch assembly eliminates polishing while insuring release of the cradle from the cradle-latch interface surfaces.

4 Claims, 3 Drawing Sheets

15

MOLDED CASE CIRCUIT BREAKER BRAID CONDUCTOR WITH STRAIN RELIEF

BACKGROUND OF THE INVENTION

U.S. Pat. No. 4,513,268 entitled "Automated Q-Line Circuit Breaker" describes a molded case residential circuit breaker employing a thermal-magnetic trip unit to automatically sense overcurrent circuit conditions and to automatically interrupt circuit current accordingly. The thermal-magnetic trip unit electrically connects with the movable contact arm by means of a braided electrical conductor to provide movable electrical connection. When the circuit breaker is subjected to overcurrent conditions or repeated circuit interruption under test circuit conditions, mechanical stress is exerted upon the welded connection between the end of the braid conductor and the movable contact arm. When the circuit breaker is designed for higher ampere interruption, such as within industrial applications, some means must be employed to reduce the strain exerted upon the welded connection between the movable braid conductor and the movable contact arm.

Thus, one purpose of the invention is to provide strain relief to the welded connection between the circuit breaker movable contact arm and the braid conductor. It is well appreciated in the electric circuit protection field that the latching surfaces within circuit breakers must be carefully machined and lubricated in order to ensure repeated latching and unlatching between the surfaces over long periods of continuous use. When such circuit breakers are rated for industrial applications, it would be economically advantageous to manufacture such latching surfaces without the requirements of extensive machining and polishing operations.

It is accordingly a further purpose of the invention to provide such latching surfaces without requiring machining or polishing while maintaining repeated interruptions over long periods of continued use at higher rated currents.

SUMMARY OF THE INVENTION

Strain relief is provided to the welded attachment between the circuit breaker braid conductor and the movable contact arm in the form of a helical spring arranged around the end of the braid conductor prior to welding the braid conductor to the movable contact arm. The latching surfaces of the circuit breaker operating cradle and the thermal-magnetic latch are metal phosphate coated to provide a smooth operating interface surface for repeated operation over long periods of continuous usage.

DESCRIPTION OF THE PREFERRED EMBODIMENT

Figure 1:
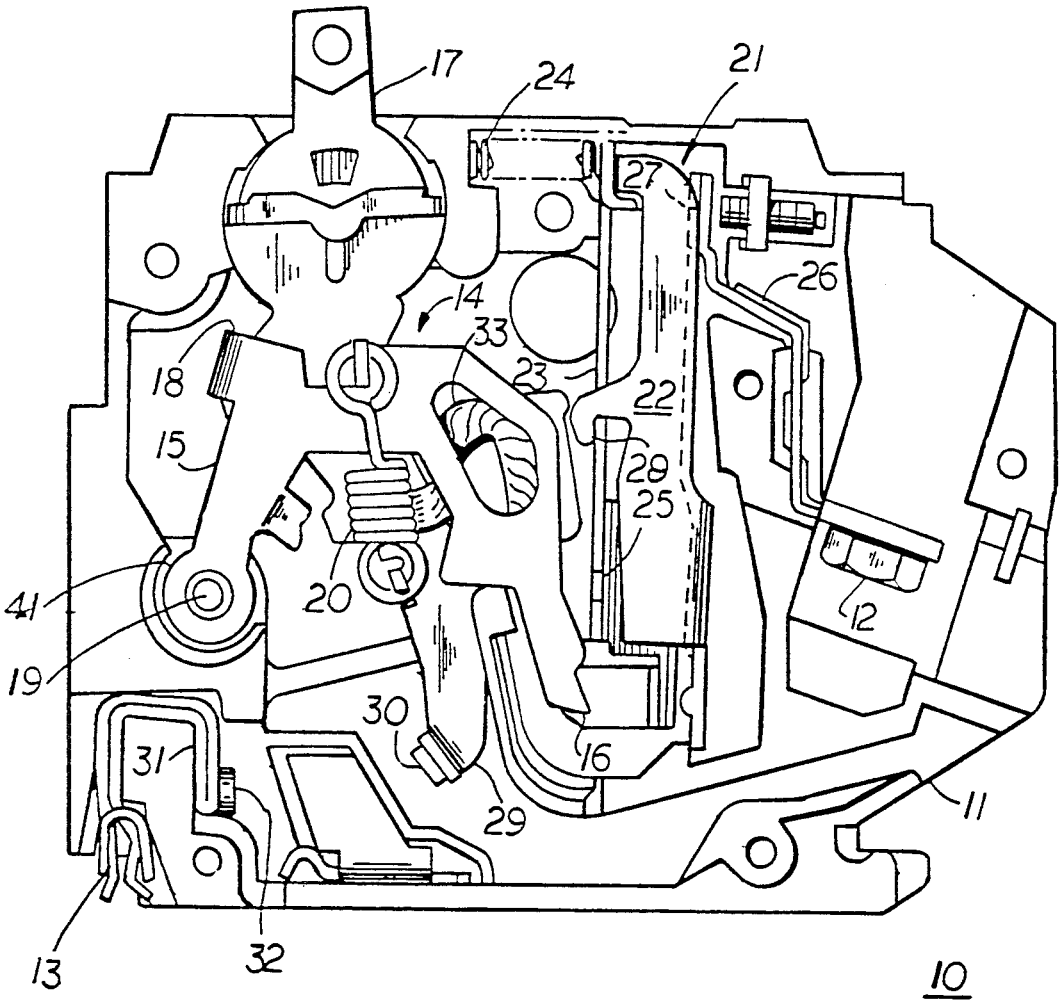
FIG. 1 PRIOR ART
FIG. 1 is a front view of a molded case circuit interrupter according to the prior art with the cover removed to display the circuit breaker operating components.
Figure 2:
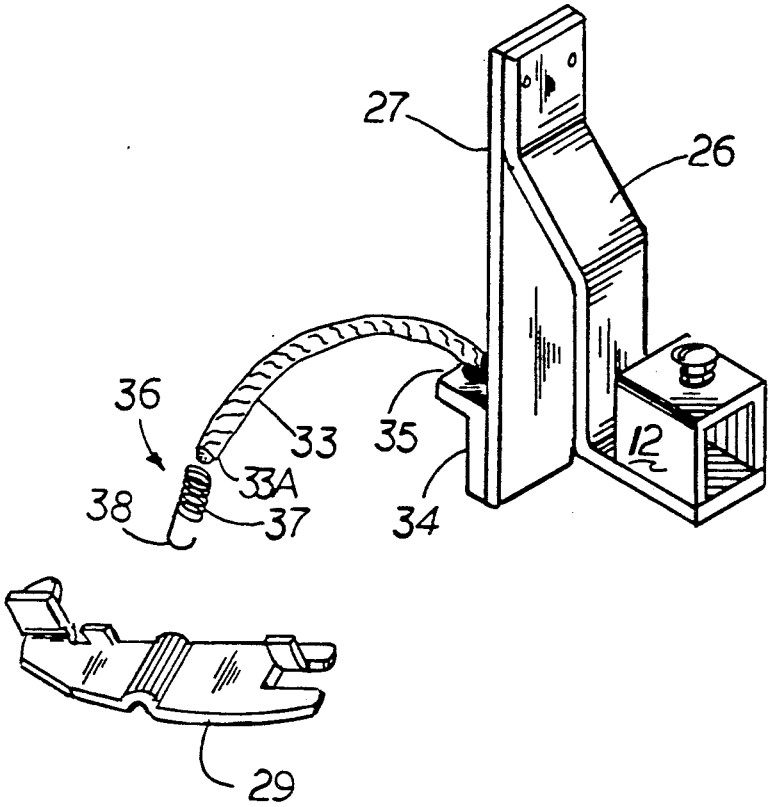
FIG. 2 is a top perspective view of the circuit breaker bimetal and line terminal connector prior to attachment of the strain relief spring in accordance with the invention.

A molded case circuit breaker 10 is depicted in FIG. 1 and consists of a plastic base 11 which incorporates a line terminal lug 12 at one end and a load terminal lug 13 at an opposite end for connection within an electrical power distribution circuit. As described within the aforementioned U.S. Pat. No. 4,513,268, an operating mechanism 14 including the pivotally-mounted cradle operator 15 terminating in a cradle hook 16 at one end and at a cradle pivot 19 within a journal recess 41 at an opposite end is used to automatically interrupt circuit current. The circuit current can be manually interrupted by means of the handle operator 17 that interacts with the operating mechanism by means of the operating cradle tab 18. The operating spring 20 becomes over centered when the handle operator is moved between "ON" and "OFF" positions. The thermal-magnetic trip unit 21 which contains the magnetic core 22 and pivotally-mounted armature 23 interrupts circuit current under intense short circuit overcurrent conditions. The compression spring 24 adjusts the sensitivity of the armature 23 to provide calibration function The latch 25 is a slotted opening in the armature which receives the cradle hook 16 under quiescent current operating conditions to retain the operating mechanism from interrupting the circuit current. The bimetal 27 interrupts the circuit current upon so-called "long time" and "short time" overcurrent conditions by flexing in response to predetermined overcurrent conditions for predetermined periods of time and rotates the armature 23 by contacting the core 22 which interacts with the armature by means of the hook projection 28. The rotation of the armature 23 removes the latch 25 from the cradle hook 16 and allows the movable contact arm 29 which carries the movable contact 30 at one end to separate from the fixed contact 32 which is attached to the fixed contact arm 31. The cradle operator 15 rotates about the cradle pivot 19 which is located within the journal recess 41 formed within the circuit breaker case. As further described with the aforementioned U.S. Pat. No. 4,513,268, electrical connection is maintained between the movable contact arm 29 and the bimetal 27 by means of a flexible braid conductor 33. The attachment between the line strap 26, braid conductor 33 and movable contact arm 29 is best seen by referring now to FIG. 2.

Figure 3:
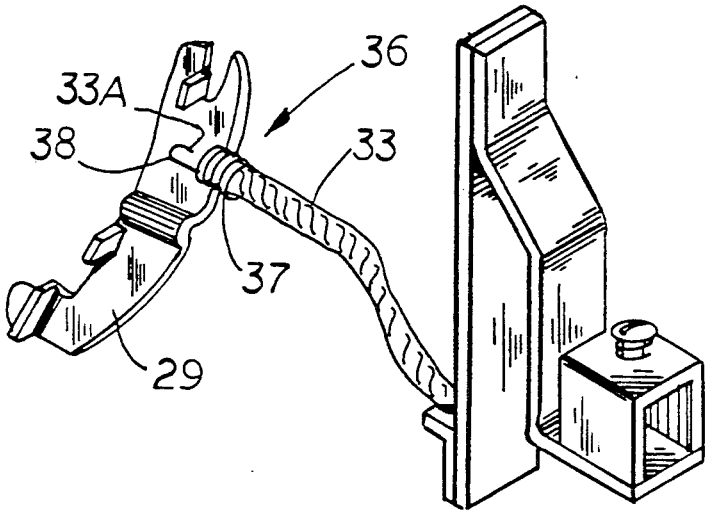
FIG. 3 is a front perspective view of the bimetal and line terminal connector of FIG. 2 after attachment of the braid conductor and strain relief spring of FIG. 2.

In order to provide strain relief to the braid conductor 33, the line terminal lug 12 is first connected to the load strap 26 and the braid conductor is next attached to the top part 35 of the extension 34 attached to the bottom of the bimetal 27. Before attaching the end 33A of the braid conductor to the movable contact arm 29, a strain relief spring 36 consisting of a helical body portion 37 and a hooked end 38 is first positioned over the end of the braid conductor and the end of the braid conductor is then welded or brazed to the movable contact arm as best seen by now referring to FIG. 3.

The hooked end 38 is welded or brazed to the movable contact arm 29 along with the end 33A of the braid conductor 33, leaving the helical body 37 of the strain relief spring 36 free to flex in response to movement of the braid conductor to thereby alleviate any tension that would otherwise occur at the welded or brazed connections.

Figure 4:
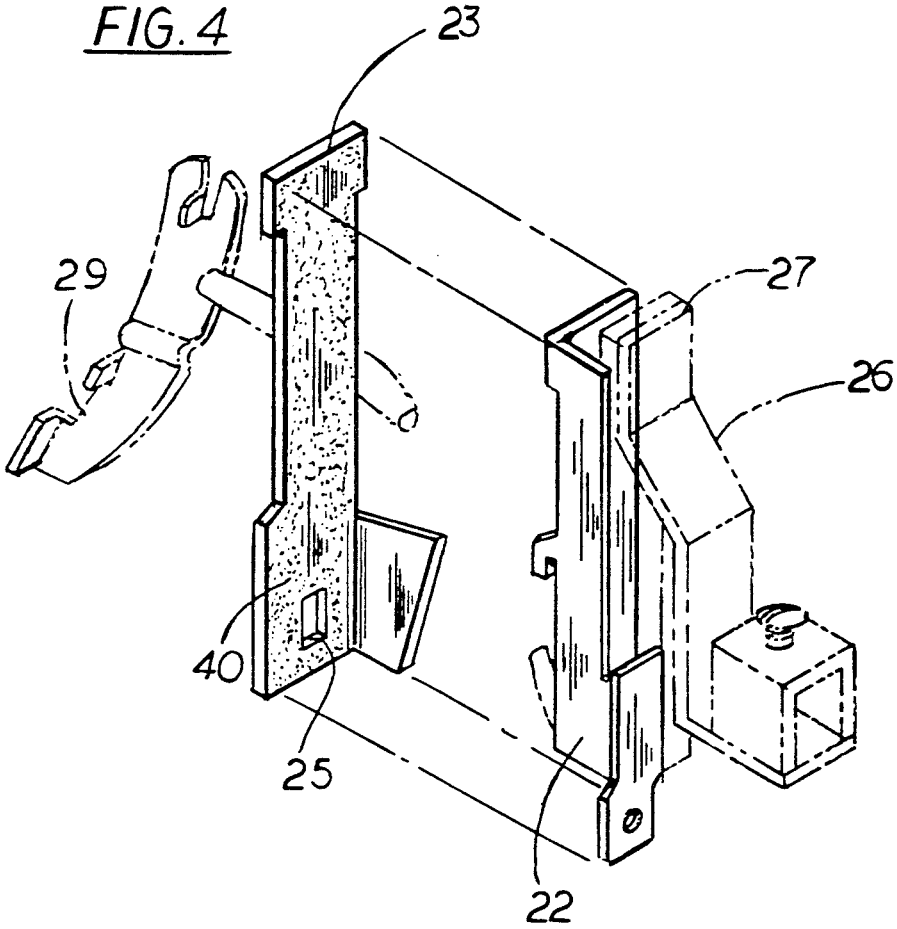
FIG. 4 is a front perspective view of the thermal-magnetic trip unit prior to assembly depicting the metal phosphate coating on the latching surface.

In order to provide a continuously smooth surface on the latch 25 formed within the armature 23, as shown in FIG. 4, a combined tin phosphate-zinc phosphate coating 40 is plated onto the entire surface of the armature 23. The armature is then positioned over the core 22. The load strap 26 with the bimetal 27 attached to is then positioned on the core.

Figure 5:
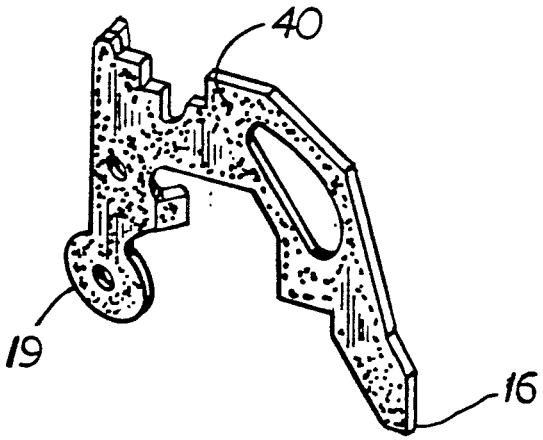
FIG. 5 is a front perspective view of the cradle operator used within the circuit breaker of FIG. 1 depicting the metal phosphate coating on the cradle operator in accordance with the invention.

A similar tin phosphate-zinc phosphate coating 40 is plated on the surface of the cradle operator 15, as shown in FIG. 5, to promote a continuously smooth surface to the cradle hook 16 and allow a frictionless transfer between the cradle hook and the latch while, at the same time, promoting smooth rotation of the cradle pivot 19 within the journal recess 41 formed within the circuit breaker case 11 depicted earlier in FIG. 1.

Although the strain relief spring and zinc phosphate-tin phosphate coated latching surfaces of the invention are depicted herein within a residential-type circuit breaker, this is by way of example only. Strain relief springs and tin phosphate-zinc phosphate coatings also find application within industrial-rated breakers such as those described within U.S. Pat. Nos. 4,679,016 and 4,731,921.

Having thus described our invention, what we claim as new and desire to secure by Letters Patent is:

1. An improved molded case circuit breaker of the type having a flexible braid conductor connecting between a thermal-magnetic trip unit and a movable contact arm wherein the improvement comprises:

a strain relief spring interfacing between the braid conductor and the movable contact arm to provide strain relief between said braid conductor and said contact arm when said movable contact arm moves between open and closed positions.

2. The circuit breaker of claim 1 wherein said strain relief spring comprises a helical body and a hooked end.

3. The circuit breaker of claim 2 wherein said helical body member is arranged over one end of said braid conductor and said one end is welded or brazed to said movable contact arm.

4. The circuit breaker of claim 3 wherein said hooked end is welded or brazed to said contact arm.

* * * * *